United States Patent [19]

Nozaki

[11] 4,165,963

[45] Aug. 28, 1979

[54] HOT WATER HEATER BURNER ASSEMBLY

[75] Inventor: Michio B. Nozaki, LaGrange, Ill.

[73] Assignee: Rheem Manufacturing Company, New York, N.Y.

[21] Appl. No.: 845,780

[22] Filed: Oct. 26, 1977

Related U.S. Application Data

[63] Continuation of Ser. No. 682,622, May 3, 1976, abandoned.

[51] Int. Cl.[2] ..... F23D 13/40

[52] U.S. Cl. ..... 431/354; 239/554; 239/433

[58] Field of Search ..... 122/17; 126/361, 363; 431/354, 355; 239/433, 434, 434.5, 552, 554

[56] References Cited

U.S. PATENT DOCUMENTS

| | | | |
|---|---|---|---|
| 1,179,607 | 4/1916 | Campbell | 431/355 |
| 1,420,277 | 6/1922 | Packer | 431/354 |
| 1,471,104 | 10/1923 | Cornwell et al. | 431/354 |
| 2,985,233 | 5/1961 | Stellmach | 431/355 |
| 3,124,108 | 3/1964 | Wenczl | 122/17 |
| 3,324,925 | 6/1967 | McLaren | 239/434 |

FOREIGN PATENT DOCUMENTS

| | | | |
|---|---|---|---|
| 640037 | 4/1962 | Canada | 431/355 |

*Primary Examiner*—Carroll B. Dority, Jr.
*Attorney, Agent, or Firm*—Allegretti, Newitt, Witcoff & McAndrews

[57] ABSTRACT

An improved burner assembly for a water heater includes a gas supply tube with a uniquely constructed end portion for mounting the burner support bracket and burner. The end portion is partially flattened on its top surface and includes an attached gas discharge orifice. The burner supply bracket is attached directly to the end portion or is otherwise supported on the end portion so that gas passing through the discharge orifice appropriately mixes with air for combustion by the burner supported by the bracket.

3 Claims, 8 Drawing Figures

Fig. 1
(PRIOR ART)
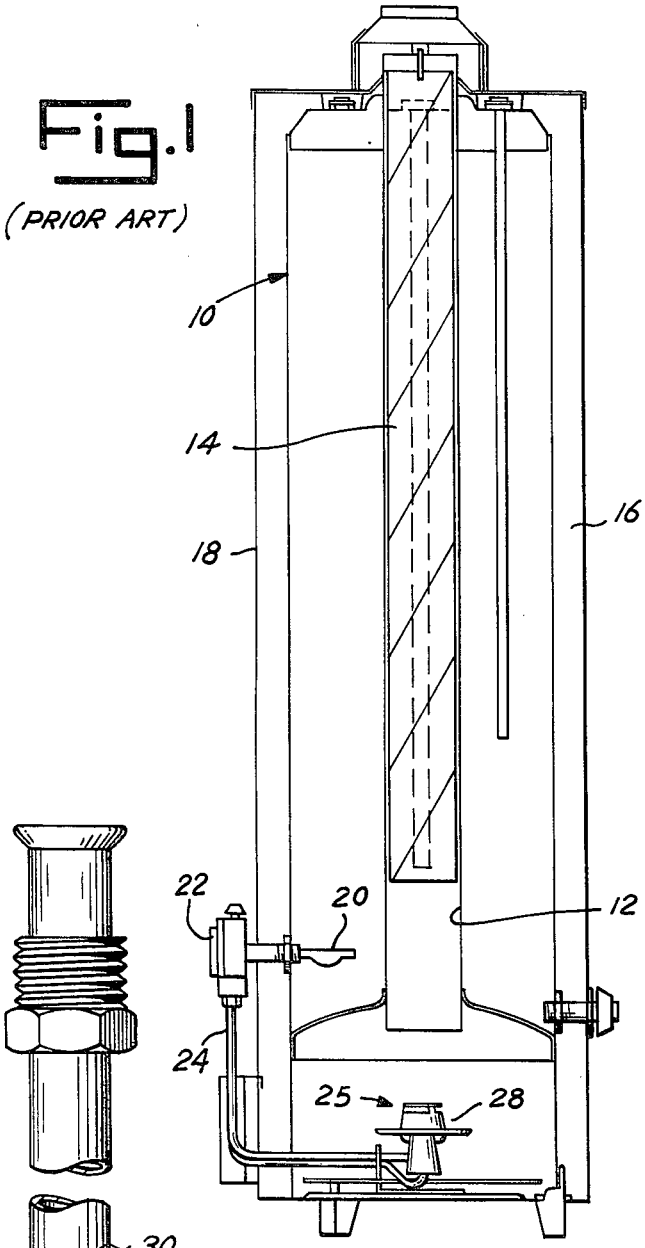
Fig. 2
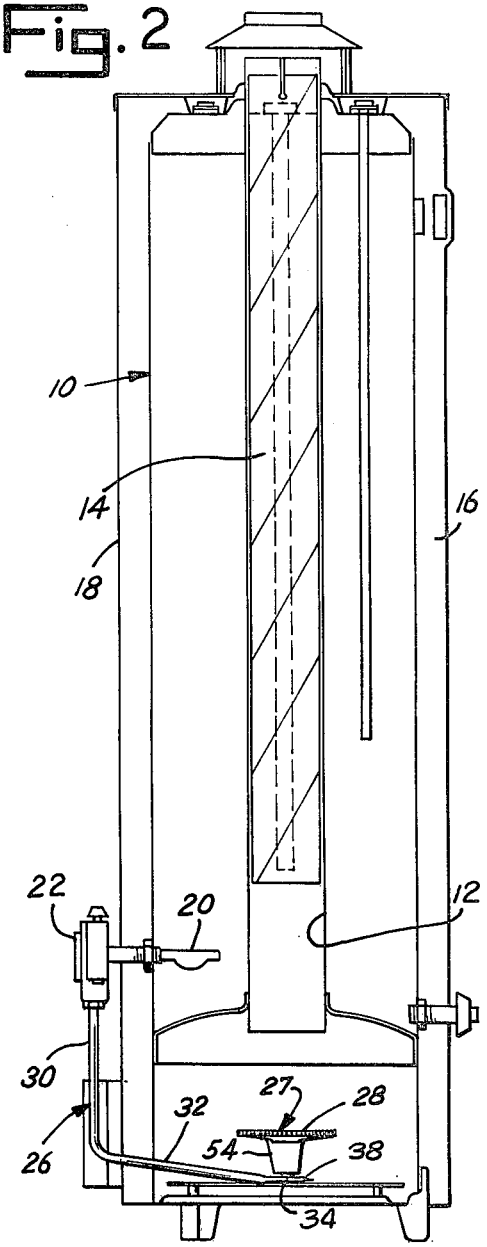
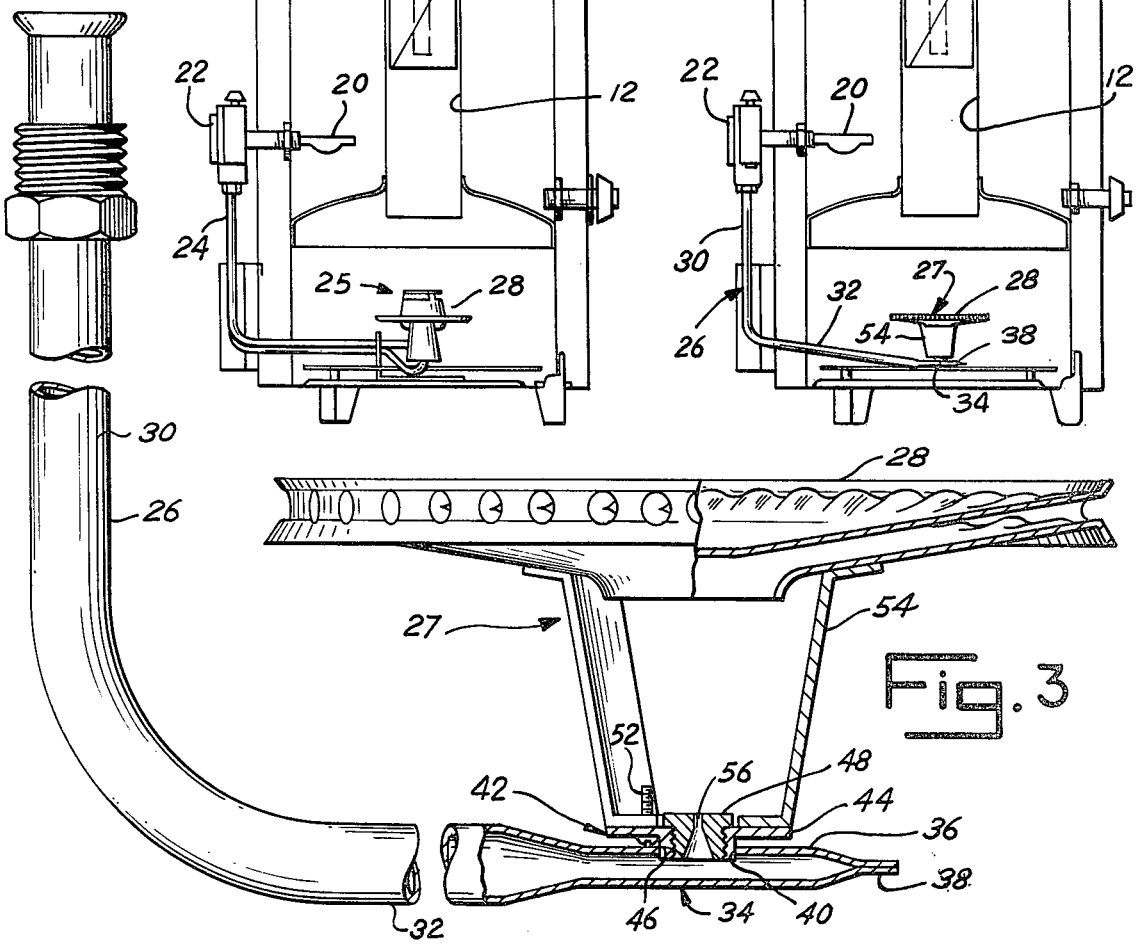
Fig. 3

HOT WATER HEATER BURNER ASSEMBLY

This is a continuation of application Ser. No. 682,622 filed May 3, 1976 and now abandoned.

BACKGROUND OF THE INVENTION

This invention relates to an improved burner construction for water heaters and more particularly to the construction of the burner supply pipe for the burner construction.

The basic construction of a domestic gas hot water heater includes a cylindrical tank for the water with a concentric flue pipe projecting through the tank to the bottom of the tank. A burner unit is positioned adjacent the bottom of the tank so that burner combustion products will flow upwardly through the flue pipe and appropriate exhaust passages to the atmosphere. The entire assembly is surrounded by insulation.

The burner is generally supported on a burner supply pipe by means of special bracket assembly. Typically, burner supply pipes are tubular and include a horizontal run along the bottom side of the tank. This horizontal run makes a vertical upward turn and generally terminates with a gas orifice or nozzle. A bracket assembly is mounted over the gas orifice or nozzle to support the burner. Gas then ejects from the orifice or nozzle for mixing with air. The mixture flows upwardly to the burner for combustion so that the water in the tank may be heated.

In order to conserve space within the water heater tank assembly, and reduce the height of the total assembly as much as possible, it is desirable to minimize the vertical height of the burner assembly, including the burner supply pipe. Heretofore, because of the necessity for directing the burner supply orifice in a vertical direction upward toward the burner, the profile of the burner assembly has not been sufficiently flat to accomplish the objective of reducing the height of the heater. Since the burner must be spaced an adequate vertical distance above the orifice to provide adequate aspiration for primary air and complete combustion at the burner, the burner profile cannot be decreased by placing the burner closer to the gas discharge orifice. The present invention, however, provides an improved burner supply pipe structure which decreases the burner assembly profile relative to prior art burner assemblies.

SUMMARY OF THE INVENTION

The present invention comprises an improved burner assembly for a water heater of the type which includes a horizontal supply tube for providing combustible gas to a burner unit. The supply tube of the present invention is generally cylindrical and terminates with an end portion flattened at least on its top side to a dimension of approximately one-half the diameter of the tube. The extreme end of the tube is then sealed. A gas orifice may be directly incorporated in the flattened top side of the supply tube or it may be attached thereto. A mounting bracket is also attached to the flat top side of the end portion of the supply tube for support of the burner. In this manner, gas discharging from the end portion of the supply tube passes through the orifice in the top side of the supply tube in an upward vertical direction for mixing with air and combustion at the burner.

Thus, it is an object of the present invention to provide a burner assembly having an improved burner supply tube.

It is a further object of the present invention to provide a burner supply tube which minimizes the height of the total burner assembly resulting from the burner supply tube and orifice configuration.

Still another object of the present invention is to provide a burner supply pipe wherein a gas orifice is positioned in a lateral or side portion of the burner supply tube for discharge into a burner.

A further object of the present invention is to provide a flat sheet metal burner for a water heater which is supplied with an adequate amount of gas and primary air while simultaneously being incorporated as part of a burner assembly having a low profile.

Still a further object of the invention is to reduce cost of labor, materials and the number of parts in a burner assembly relative to conventional heater burner assemblies.

These and other objects, advantages and features of the invention will be set forth in greater detail in the description which follows.

BRIEF DESCRIPTION OF THE DRAWINGS

In the detailed description which follows, reference will be made to the drawings comprised of the following FIGURES:

FIG. 1 is a cross-sectional view of a typical prior art water heater including a burner assembly for the heater;

FIG. 2 is a cross-sectional view of a typical water heater including the improved burner assembly of the present invention;

FIG. 3 is a side view of the improved burner assembly of the present invention;

DESCRIPTION OF THE PREFERRED EMBODIMENT

Figure 6:
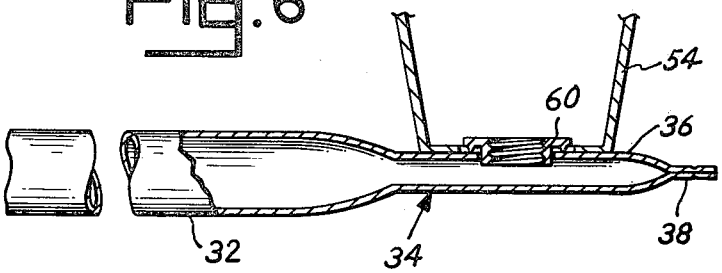
FIG. 6 is an enlarged cross-sectional view of the end portion of the burner supply tube of an alternate embodiment of the present invention.

FIG. 1 illustrates the general construction of a typical hot water heater with a prior art gas burner assembly. The heater includes a water tank 10 which is generally annular in shape and glass lined with a capacity of 100 gallons, for example. The tank 10 is constructed with an annular cross section to define a central flue chamber or flue 12. A baffle 14 is mounted in the flue 12 to augment circulation of the hot combustion products therethrough. The heater tank 12 is surrounded by insulation 16 and is supported within a jacket 18. A thermostat 20 projects into the tank and controls a valve mechanism 22 linked with a gas burner supply tube 24.

The gas burner supply tube 24 comprises a portion of a burner assembly 25. In general, the burner assembly 25 includes a burner 28 positioned on the bottom side of the tank 10 so that fuel introduced through the tube 24 may properly mix or aspirate with air for combustion and heating of water within the tank 10. The present invention relates, in particular, to the construction of an improved burner assembly distinct from the typical prior art assembly 25 in FIG. 1.

FIGS. 2 and 3 illustrate the improved burner assembly 27 of the present invention. A burner supply tube 26 includes a vertical run 30 connected with a horizontal run 32 terminating with an end portion 34. The end portion 34 of tube 26 is flattened, for example, by a forging or stamping operation, to define a burner supply pipe platform 36 which is generally flat. The end of the supply tube 26 is sealed by closing end 38 of tube 26 and welding the end portion as illustrated in FIGS. 2 and 3.

Platform 36 includes an opening 40 which may be drilled, punched or otherwise formed. A separate fitting 42 is then welded or brazed in the opening 40. Fitting 42 includes a flat planar portion or plate 44 and an internally threaded stub 46 extending through plate 44. Stub 46 is threaded to receive a burner orifice fitting or member 48.

Figure 4:
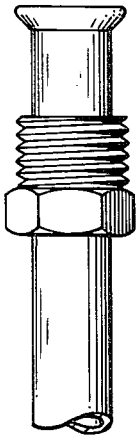
FIG. 4 is a side view of the burner supply tube for the assembly of FIG. 3.
Figure 5:
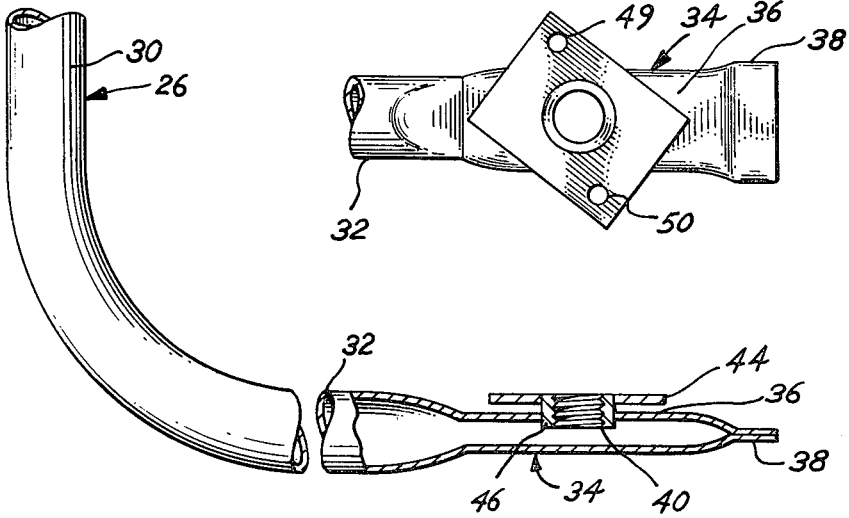
FIG. 5 is a top view of the end portion of the burner supply tube of FIG. 4.

FIG. 4 and FIG. 5 illustrate, in greater detail, the construction of the end portion 34 and fitting 42. Note that the plate 44 is generally rectangular in shape as illustrated in FIG. 4 and includes screw openings 49 and 50 which fall outside of the projection of the end portion 34. In this manner, burner mounting screws as at 52 in FIG. 3 may be inserted through the openings 49 and 50 to cooperate and attach to a burner bracket 54 which supports the burner 28. The burner bracket 54 serves to space the burner 28 an adequate distance from an orifice 56 in FIG. 3 in the burner orifice fitting 48 thereby insuring complete primary air aspiration of fuel from burner supply tube 26.

Figure 7:
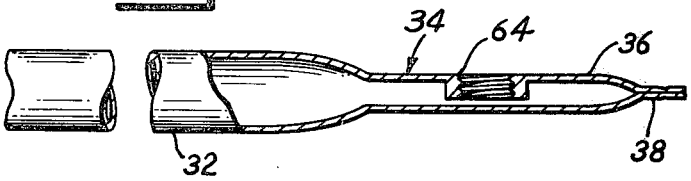
FIG. 7 is an enlarged cross-sectional view of an end portion of the burner supply tube of another embodiment of the present invention.
Figure 8:
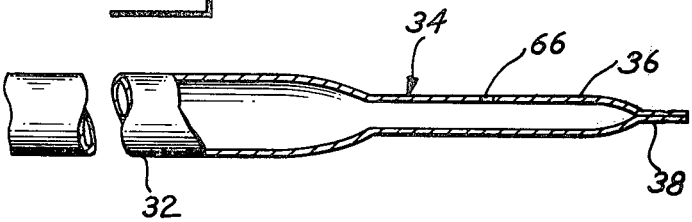
FIG. 8 is an enlarged cross-sectional view of the end portion of a burner supply tube of a third embodiment of the invention.

FIGS. 6 through 8 illustrate variations of the supply tube construction for the improved burner assembly of the present invention. In FIG. 6, burner bracket 54 is welded or brazed directly to the flat platform 36 of end portion 34. An orifice spud 60 is then welded or brazed flush with the platform 36 and a fitting (not shown) for the orifice may be threaded into the spud 60.

In FIG. 7, the end portion 34 of the tube 26 is bored by hot spinning, for example, to define an opening 64 which is subsequently tapped. An orifice spud or fitting of the type illustrated in FIG. 6 may then be threaded into the opening 64. The burner bracket 54, though not shown in FIG. 7, would be welded directly to the platform 36.

In FIG. 8, the burner bracket 54, though again not shown, would be welded directly to the platform 36 of end portion 34. Also, the gas orifice is defined by a small drilled opening 66 in the flat platform 36 of end portion 34. This would eliminate the need for any spud and separately defined orifice.

With the present invention, the number of parts relative to prior art burner assemblies has been minimized or reduced. Moreover, each part can be made by simple sheet metal stamping and tube forming operations. Expensive machining operations are substantially eliminated. The lateral orifice design of the burner supply tube 26 permits maximization of the distance between the burner 28 and the gas orifice and minimization of the overall height of the burner assembly. Total aspiration and complete combustion of the gas-air mixture is thereby insured. This feature is emphasized by a comparison of FIGS. 1 and 2. In FIG. 2, the assembly 27 has replaced the prior art assembly 25 shown in FIG. 1. The assembly 27 has additional volume between the burner 28 and tank 10. Thus, combustion is more likely to be complete. Maximum heat transfer occurs. These advantages are effected without changing the size or shape of the total water heater assembly.

The flat platform 36 may also be used as a reference base for attachment of the burner in true alignment with the orifice opening. This substantially eliminates elaborate assembly tooling required in many prior art burner assemblies. Thus, while in the foregoing there has been set forth preferred embodiments of the present invention, it is to be understood that the invention shall be limited only by the following claims and their equivalents.

What is claimed is:

1. An improved burner construction for a water heater comprising, in combination:

a burner supply tube having a first diameter, said supply tube including a first horizontal run terminating with an end portion, said end portion being flattened to a dimension approximately one-half the diameter of the tube and sealed at the extreme end of the tube to define a flat top surface of the end portion;

a gas-flow passage in the flat top surface of the end portion;

a bracket;

a burner attached to the bracket;

means for attaching the bracket over the gas-flow passage;

said means for attaching the bracket comprising a horizontal, planar platform surface member with a fitting projecting from the surface member through said passage, said fitting including a burner orifice through the platform member, said bracket removably attached by fasteners to said platform member whereby the burner is maintained in alignment with the passage and orifice to receive a mixture of fuel and air for combustion by the burner.

2. The burner construction of claim 1 wherein said fitting includes an internally threaded stub projecting from the platform member, said stub being welded to the burner supply tube and also including an orifice fitting which is screw fitted in the threaded stub.

3. The improved construction of claim 1 wherein said gas-flow passage is defined by a drilled opening of predetermined orifice size in the flat surface of said end portion.

* * * * *